United States Patent [19]

Aquino

[11] Patent Number: 4,607,817

[45] Date of Patent: Aug. 26, 1986

[54] COLLAPSIBLE PODIUM

[76] Inventor: Salvatore A. Aquino, 337 Trevor La., Bala Cynwyd, Pa. 19004

[21] Appl. No.: 731,070

[22] Filed: May 6, 1985

[51] Int. Cl.[4] ..... A47B 97/04

[52] U.S. Cl. ..... 248/459; 206/214; 248/165; 248/166; 248/460

[58] Field of Search ..... 248/459, 457, 472, 474, 248/454, 473, 452, 136, 460, 165, 166, 174; 206/214; 40/155

[56] References Cited

U.S. PATENT DOCUMENTS

| | | | |
|---|---|---|---|
| 1,632,185 | 6/1927 | Jenner | 248/459 |
| 2,222,665 | 11/1940 | Hoenigsberg | 248/459 |
| 3,119,194 | 1/1964 | Ray | 45/57 |
| 3,195,850 | 7/1965 | Steiner | 248/454 |
| 3,305,206 | 2/1967 | Nichols | 248/459 |
| 3,367,679 | 2/1968 | Slanhoff | 281/33 |
| 3,410,516 | 11/1968 | Criswell | 248/459 |
| 3,550,895 | 12/1970 | Guiles | 248/459 |
| 3,758,065 | 9/1973 | Ranseen | 248/459 |
| 4,105,182 | 8/1978 | Jacobson | 248/459 |
| 4,150,807 | 4/1979 | Manso | 248/460 X |
| 4,274,616 | 6/1981 | Radtke | 248/459 |
| 4,318,471 | 3/1982 | Hutton | 206/214 |

*Primary Examiner*—Ramon O. Ramirez

*Attorney, Agent, or Firm*—Benasutti & Murray

[57] ABSTRACT

A collapsible podium comprising a front panel, a rear panel, and a flat floor panel all in hinged relationship to each other essentially along respective adjacent edges. The floor panel has a rear portion and a front portion in hinged relationship to each other. Disposed along essentially the lower edge of the front panel is a lip projecting forwardly at essentially a right angle with said front panel and at an upward angle from a horizontal plane. The podium collapses and folds along the several hinged relationships, and can have releasable securement means which maintains the podium in a folded configuration.

4 Claims, 3 Drawing Figures

COLLAPSIBLE PODIUM

BACKGROUND OF THE INVENTION

This invention relates to a podium usable for holding books, papers, and the like in position, but which can be collapsed and folded after use for convenient transport and storage.

It is generally recognized that the use of a podium for retaining books or papers in a convenient mode for reading is beneficial to a user. Thus, whether the user is giving a speech, is in a library or office, or is confined to bed, a podium can be a highly efficient instrument for maintaining reading and study materials.

Among the most familiar podiums are those which are made of wood or metal and are usually found in formal settings. These podiums are constructed to be permanently rigid, and therefore offer little in practical portability. Certain foldable podiums, desks, and easels have been developed, but it is generally found that these devices are rather complicated in their assemblies and/or do not have universal utility. It is therefore evident that a need is present for a portable podium that provides a satisfactory structure while in use, yet easily collapses and folds for subsequent storage or transport.

SUMMARY OF THE INVENTION

It is a primary object of this invention to provide a collapsible podium which exhibits structural stability while in use, yet conveniently and easily folds for storage.

Another object of the invention is to provide a collapsible podium which, when in its open configuration, maintains a firm, flat base on its supporting structure.

Another object of the invention is to provide a collapsible podium which is easy to erect and use.

A further object of the invention is to provide a collapsible podium which can be folded and maintained in its folded position.

Yet another object of the invention is to provide a collapsible podium which can be constructed easily and with relatively inexpensive materials.

These and other objects of the invention will become apparent throughout the specification.

Accordingly, the subject of the instant invention is a collapsible podium comprising a front panel, a back panel, and a flat floor panel. The front and back panels are in hinged relationship to each other along their respective top edges. Essentially the rear edge of the floor panel is in hinged relationship with essentially the bottom edge of the rear panel, while essentially the front edge of the floor panel is in hinged relationship with essentially the bottom edge of the front panel. The floor panel has a rear portion and a front portion in hinged relationship to each other. Along essentially the lower edge of the front panel is disposed a lip upon which books, papers, and the like can rest. The lip is at essentially a right angle with the front panel and at an upward angle from a horizontal plane.

The podium here disclosed can be collapsed by moving the rear panel toward the front panel via utilization of the several hinged relationships described above. Such action causes the front and rear portions of the floor panel to fold outwardly upon each other for ultimate folding rearwardly until adjacent the outer surface of the rear panel. Releasable securement means can be included to maintain such folded floor panel adjacent said outer surface of the rear panel, thereby maintaining a collapsed and folded configuration. The structure here described in its open configuration responds to weight such as a book on the lip thereof by distributing such weight as pressure to the floor panel thereof, resulting in a firm maintenance of position on a support base such as a table top or desk.

DETAILED DESCRIPTION OF A PREFERRED EMBODIMENT

Figure 1:
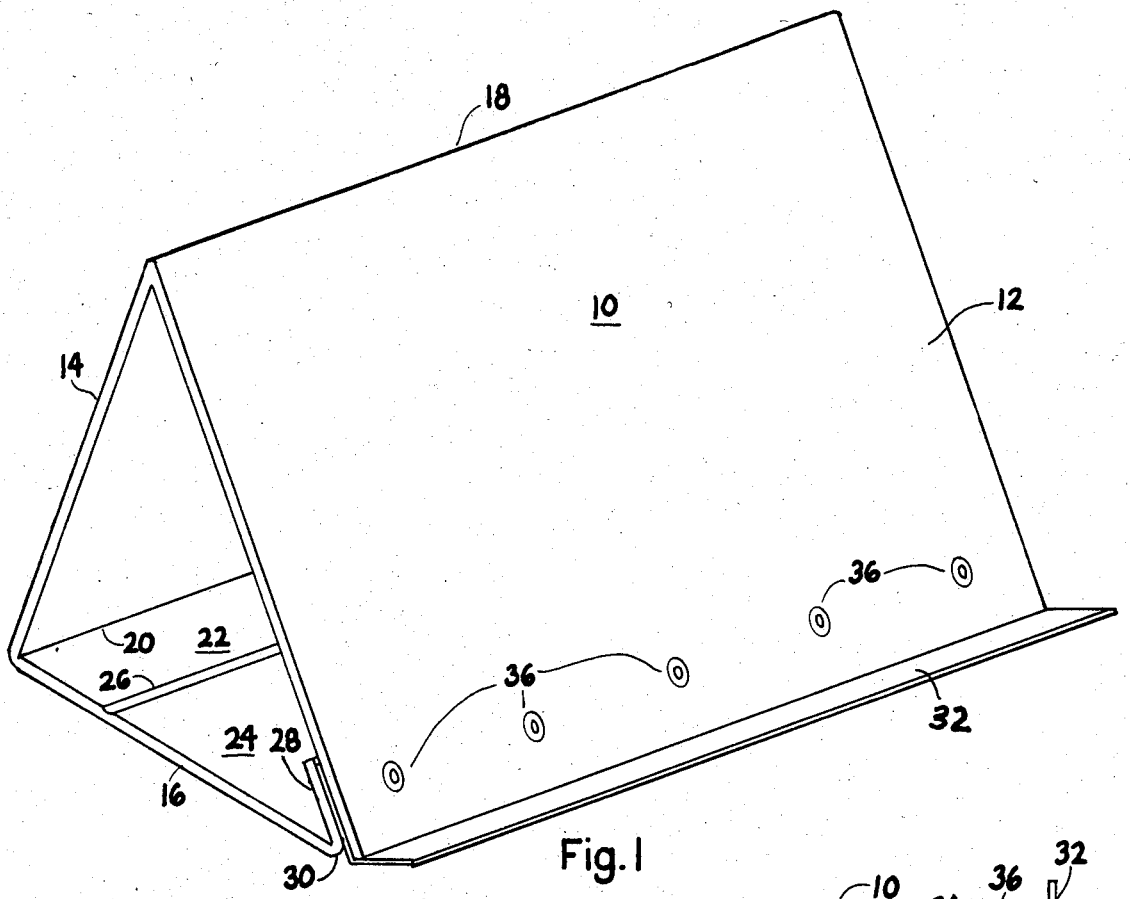
FIG. 1 is a perspective view of a collapsible podium in its open configuration.
Figure 3:
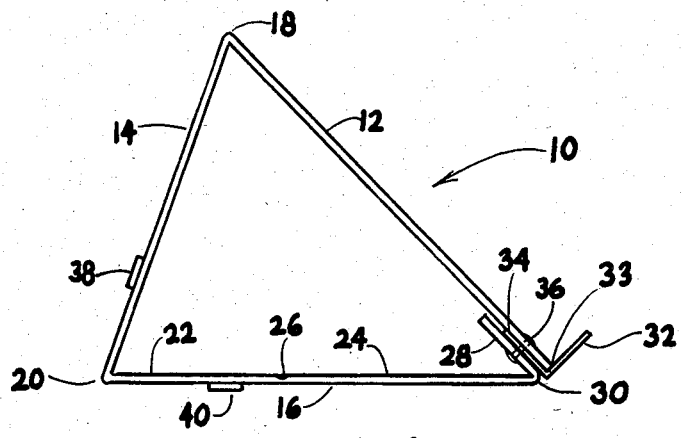
FIG. 3 is a side elevation view of the podium of FIG. 1.

Referring to FIGS. 1 and 3, a collapsible podium 10 is shown in ite open configuration. The podium 10 has a front panel 12, a rear panel 14, and a floor panel 16. The front panel 12 and rear panel 14 are hinged to each other along their respective top edges at 18, while the floor panel 16 is hinged at 20 along its rear edge to the bottom edge of the rear panel 14. Said floor panel 16 has a rear portion 22 and a front portion 24, with each of said portions hinged to each other at 26. The front portion 24 additionally has a front extension 28 which is hinged to said front portion 24 at 30. A lip 32 is disposed along the lower edge of the front panel 12. In the embodiment here shown, the lip 32 is the horizontal component of an L-shaped structure 33 whose vertical component 34 is disposed between the front face of the front extension 28 and the backside of the lower portion of the front panel 12. The hinging at 30 is in planar alignment with the bottom edge of the front panel 12. Rivets 36 secure the front extension 28, vertical component 34, and lower portion of the front panel 12 together. The lip 32 projects outwardly from the front panel 12 at essentially a right angle with said front panel 12 and at an upward angle from a horizontal plane. The floor panel 16 is flat when the podium 10 is open.

Figure 2:
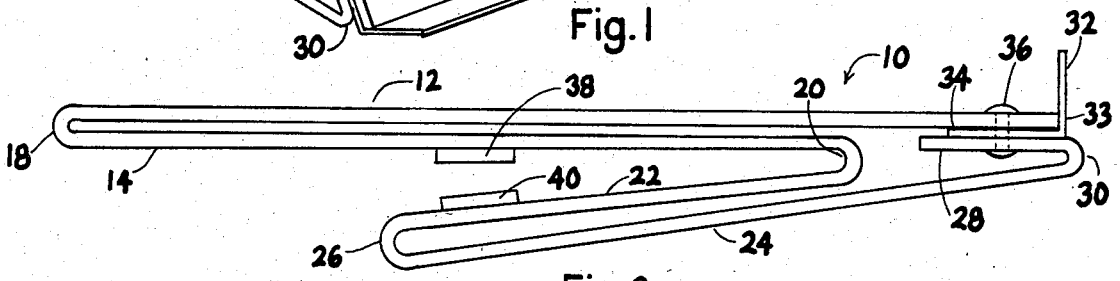
FIG. 2 is a side elevation view of the podium of FIG. 1 in a collapsed configuration.

FIG. 2 illustrates the podium 10 in a collapsed configuration. Thus, the rear panel 14 is moved forwardly via utilization of the hinging at 18, 20, 26 and 30, resulting in a juxtapositioning of the inner surfaces of the rear panel 14 and the front panel 12. The floor panel 16 folds upon itself via utilization of the hinging at 26, and is folded rearwardly via utilization of the hinging at 30 to be adjacent the outer surface of the rear panel 14. Optionally, releasable securement means to maintain the podium 10 in a fully folded configuration can be employed. Thus, as shown in FIGS. 2 and 3, complementary pieces of Velcro material 38, 40 can be disposed respectively on the outer surfaces of the rear panel 14 and the rear portion 22 of the floor panel 16 to retain the floor panel 16 in its folded position adjacent the rear panel 14. Said Velcro is described in U.S. Pat. No. 3,009,235. Alternatively, of course, other securement means such as complimentary friction-fit snaps, releasable adhesive, or the like, can be employed as would be evident to the skilled artisan.

Materials utilized in constructing the podium 10 should be of sufficient structural rigidity to support a book or the like in upright position against the front panel 12. While plastic, metal, or wood can be utilized, it has been found that corrugated cardboard can be employed for the panels 12, 14, 16, while a rigid plastic can be employed for the L-shaped lip structure 33. When such cardboard is used, the various hinging sites can simply be formed with score lines which impart effective hinge qualities to said cardboard. Of course, other hinging means can be employed as would be evident to the skilled artisan. The rivits 36 are applied as known in the art. Of course, other securement means can be employed.

Because of the flat floor panel 16 and the triangular configuration of the podium 10 as viewed from its side as in FIG. 2, placement of an object such as a book against the front panel 12 resting on the lip 32 tends to exert pressure on the podium 10 which aids in maintaining the floor panel 16 firmly against the structure on which the podium 10 resides. Thus, there is no rocking of the podium 10, and an object such as a pencil which may inadvertently come between the floor panel 16 and the structure on which the podium 10 resides will not have the effect of interrupting usefullness of said podium. Instead, such an object merely will be sandwiched between the floor panel 16 and such supporting structure.

While the above description describes a preferred embodiment, it is to be understood that this description is meant to be illustrative and not limiting, and that the scope of the invention is defined by the claims which follow.

What is claimed is:

1. A collapsible podium comprising a front panel, a back panel in hinged relationship along its top edge with the top edge of the front panel, and a flat floor panel in hinged relationship essentially along its rear edge with essentially the bottom edge of the back panel and having in hinged relationship thereto a front extension disposed to have a front surface thereof adjacent the bottom backside of the front panel with said extension attached to the front panel, with said floor panel having a rear portion and a front portion in hinged relationship to each other, and further with said front panel having disposed along essentially its lower edge a lip projecting forwardly at essentially a right angle with the front panel and at an upward angle from a horizontal plane.

2. A podium as claimed in claim 1 wherein the lip thereof is the horizontal component of an L-shaped structure, with the vertical component of said L-shaped structure being secured between the front surface of the front extension and the backside of the front panel.

3. A podium as claimed in claim 1 or 2 having in addition releasable securement means to maintain the podium in a collapsed and folded configuration.

4. A podium as claimed in claim 1 or 2 wherein the front, back, and floor panels are constructed of corrugated cardboard.

* * * * *